United States Patent [19]

Lohrbach et al.

[11] 4,194,679

[45] Mar. 25, 1980

[54] SELF-LOCKING CONTAINER

[75] Inventors: Mervin Lohrbach, Anaheim; Richard Peeples, Placentia, both of Calif.

[73] Assignee: Champion International Corporation, Stamford, Conn.

[21] Appl. No.: 958,186

[22] Filed: Nov. 6, 1978

[51] Int. Cl.[2] ..... B65D 5/10; B65D 5/66

[52] U.S. Cl. ..... 229/39 R; 229/45 R

[58] Field of Search ..... 229/39 R, 44, 45, 52 B

[56] References Cited

U.S. PATENT DOCUMENTS

| | | | |
|---|---|---|---|
| 1,481,592 | 1/1924 | Dozier | 229/52 B X |
| 2,384,559 | 9/1945 | Powell | 229/39 R |
| 2,702,154 | 2/1955 | Linson | 229/39 R |
| 2,832,527 | 4/1958 | Bosche, Jr. | 229/39 R |
| 2,835,432 | 5/1958 | Wilmot | 229/39 R |
| 3,018,029 | 1/1962 | Fellowes | 229/39 R |
| 3,330,467 | 7/1967 | Johnson | 229/44 R |
| 3,473,722 | 10/1969 | Rohde | 229/39 R X |
| 3,921,896 | 11/1975 | Ishimura | 229/39 R |
| 4,101,022 | 7/1978 | Watkins | 229/39 R |
| 4,126,266 | 11/1978 | Rocca | 229/39 R |

*Primary Examiner*—Davis T. Moorhead

*Attorney, Agent, or Firm*—Evelyn M. Sommer

[57] ABSTRACT

A container formed from a single, unitary paper-board blank wherein certain side and bottom wall panels of the blank are provided with openings for receiving tabs on selected other top and bottom wall-forming flaps to lock the container in its erected, closed condition, when the blank is folded.

7 Claims, 8 Drawing Figures

Fig. 1.
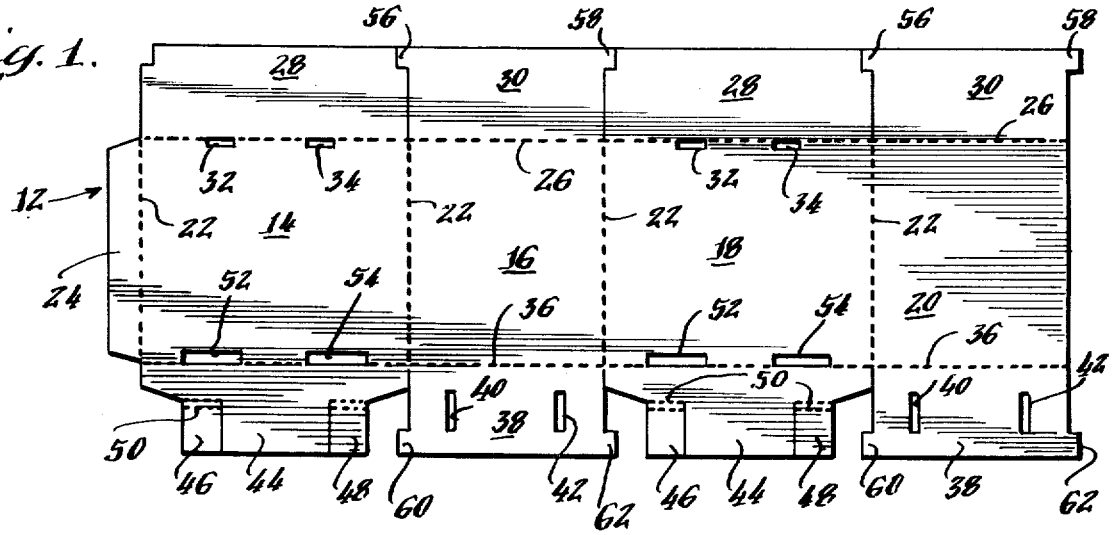
Fig. 2.
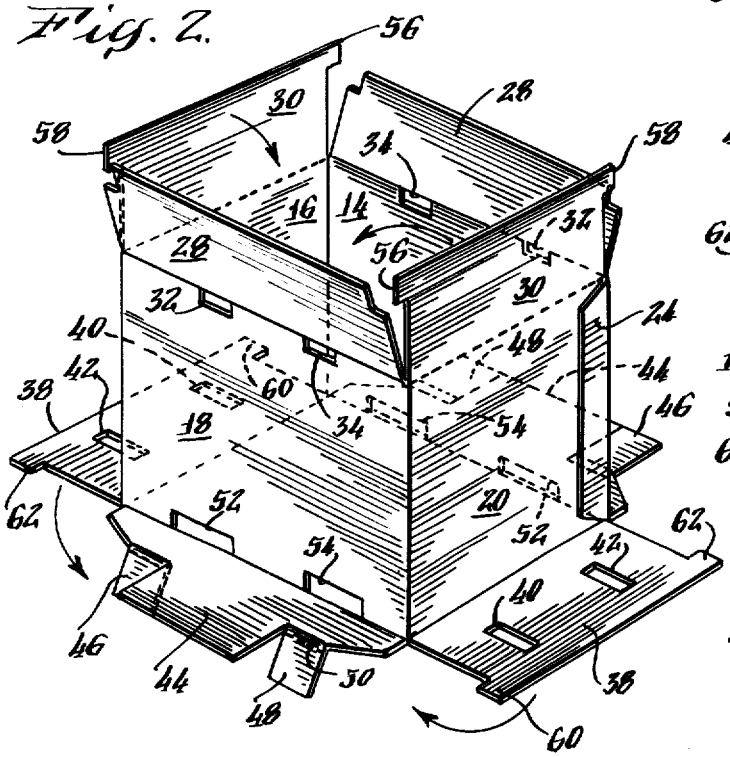
Fig. 5.
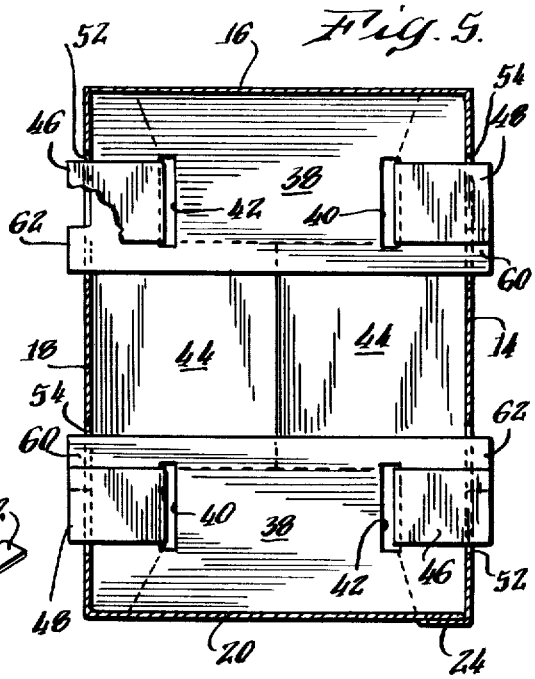
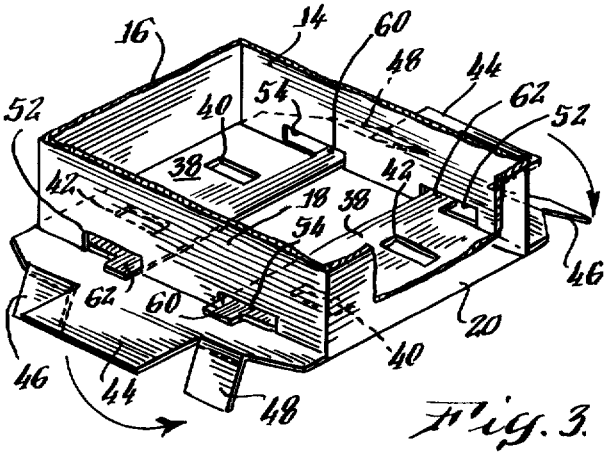
Fig. 3.
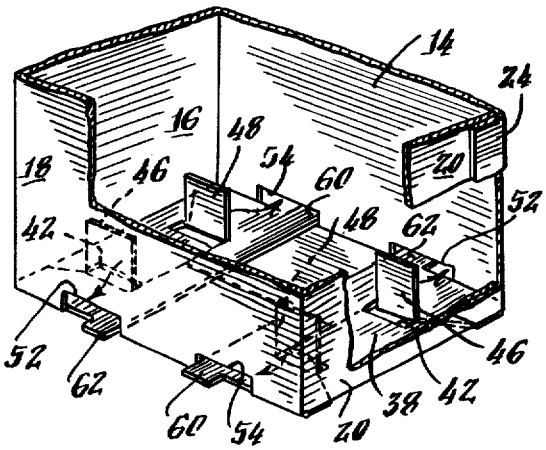
Fig. 4.

SELF-LOCKING CONTAINER

BACKGROUND OF INVENTION

1. Field of the Invention

This invention relates to a paperboard container, and more particularly, a container which may be folded from a unitary blank wherein various panels of the blank are locked to other panels when the container is erected from the blank in such a manner as to retain the dimensional stability of the container when stacked and filled.

2. Description of the Prior Art

Most self-locking container designs detract from, rather than aid, in retaining the dimensional stability of the container when the container is erected from a single blank. When such containers are stacked on their sides, rather than bottom to top, the prior art containers do not perform satisfactorily. The stress on the side walls of the container cause any locking tabs on one wall received through another to loosen as the side walls collapse inwardly under pressure. Further, if such containers are used to ship produce, since most produce is shipped under high moisture conditions, the paperboard of the container tends to weaken and sag and the locking tabs become relatively ineffective.

The design innovations incorporated in the self-locking container of the present invention overcome most of the objections of the prior art designs discussed above. Particularly, the self-locking container of the present invention offers:

(1) minor top and bottom flaps which lock into the side wall panels and eliminate the racking or the side-to-side dimensional unstability of the container under load;

(2) locking tabs between overlapped bottom flaps which are held in position by a commodity packed within the interior of the container; and (3) locking tabs on the minor top flaps which restrain the flaps against depressing, thus improving vertical stability, as well as lateral stability of the container under load.

Since the resultant, erected container is dimensionally stable, this also improves the ease of closing the container, as for example, by stapling. The lateral and vertical stability of the container is obtained by using a single, unitary paperboard blank, thus facilitating construction and making the design much less costly than in most prior art devices.

SUMMARY OF THE INVENTION

In accordance with the invention, four rectangular side wall panels of a paperboard blank connected to each other along vertical score lines are folded 90° relative to each other to provide a parallelopiped container. Connected to the top edge of the rectangular side wall panels along horizontal score lines is a top flap. The minor on inner top flaps are generally "T-shaped" in plan providing tabs along their lateral side edges. The outer top flaps are generally rectangular in shape. The tabs on each of the inner top flaps are received through openings formed along the upper score line of two of the rectangular side wall panels and are then bent 90° to lock the inner top flaps to the side walls. This provides for lateral dimensional stability as well as vertical stability upon stacking of the formed container and facilitates the stapling of the outer top flaps to each other over the inner top flaps.

Connected by a horizontal score line to the bottom edge of each of the rectangular side wall panels is a bottom flap forming the bottom of the container. The minor or inner bottom flaps provided are sustantially inverted "T-shaped" in plan. Interleaved with the inverted "T-shaped" inner flaps are a pair of outer bottom flaps.

Each of the outer bottom flaps include a pair of pivotable vertically extending tabs foldable relative to the outer bottom flap, which are received in one of a pair of vertical openings in each inner bottom flap to lock the outer flaps to the inner flaps. The tabs can be bent over the inner flap 180° so as to extend outwardly through openings formed along the lower score line in two of the side walls of the container. The tabs are then bent 90° relative to the side walls for additional locking of the container in its erected state to maintain lateral dimensional stability. Commodities packed within the interior of the container are placed on the 180° bent locking tabs to retain them in locked position, locking the outer and inner bottom flaps together, so that the bottom cannot open.

The tabs on the ends of the inner or inverted "T-shaped" bottom flaps also extend through the openings in the side walls and are bent relative thereto for additional locking strength.

BRIEF DESCRIPTION OF THE DRAWING

Further objects and advantages of the invention will become apparent from the following description and claims, and from the accompanying drawing wherein:

FIG. 1 is a plan view of a blank for forming the container of the present invention;

FIGS. 2 to 4 inclusive are perspective views illustrating the manner of folding the blank of FIG. 1 to form the self-locking container of the present invention;

FIG. 5 is a top plan view of the partially formed container of FIG. 4;

DETAILED DESCRIPTION OF THE PREFERRED EMBODIMENT

Figure 6:
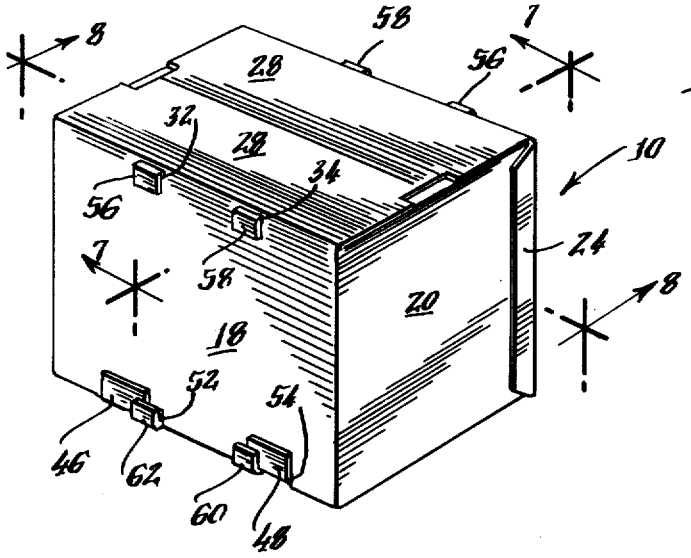
FIG. 6 is a perspective view of the erected, self-locking container of the present invention.
Figure 7:
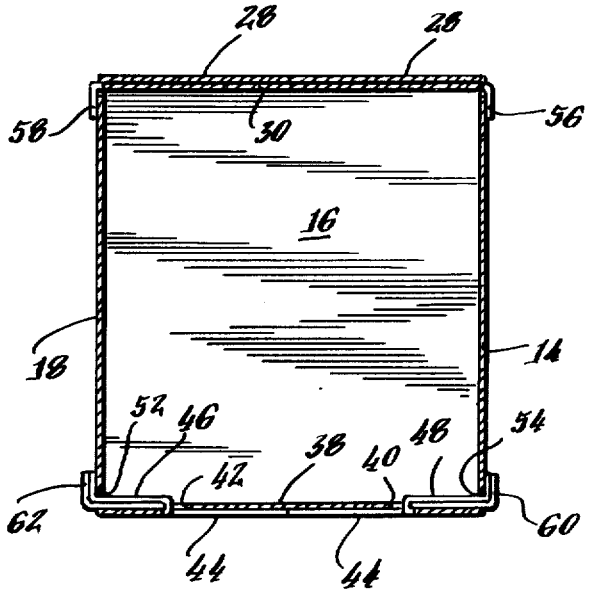
FIG. 7 is a cross-sectional view taken substantially along the plane indicated by line 7—7 of FIG. 6.
Figure 8:
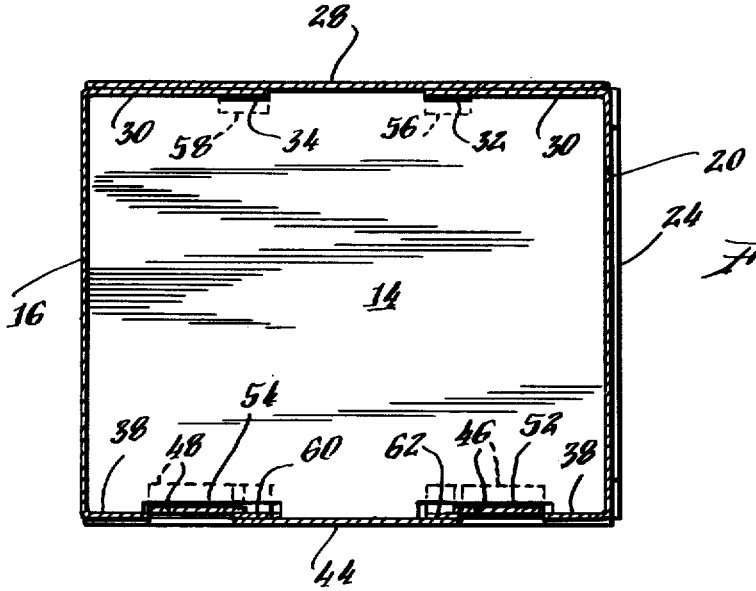
FIG. 8 is a cross-sectional view taken substantially along the plane indicated by line 8—8 of FIG. 6.

Referring now to the drawings in detail, wherein like numerals indicate like elements throughout several views, the self-locking container 10 of the present invention is formed from a unitary, paperboard blank 12 illustrated in FIG. 1.

Blank 12 includes four rectangular side wall panels 14, 16, 18 and 20, connected by vertical score lines 22. An additional, substantially rectangular panel 24 is connected by a vertical score line 22 to the left hand edge of panel 14.

Connected by a horizontal score line 26 to the top edge of rectangular side wall panel 14 is an outer top flap 28 which is substantially rectangular in shape. A similar flap 28 is connected by a horizontal score line 26 to the top edge of rectangular side wall flap 18.

An inner top flap 30 which is substantially "T-shaped" in plan is connected by a horizontal score line 16 to the top edge of rectangular side wall panel 16. A similar inner top flap 30 is connected by a horizontal score line 26 to the top edge of side wall rectangular flap 20.

Both rectangular panels 14 and 18 include a pair of rectangular openings 32, 34 spaced within the confines of the panel between vertical score lines 22 just below the top edge or horizontal score line 26. Connected to the bottom edge of each of the side wall rectangular panels 16 and 20 by a horizontal score line 36 is an inverted "T-shaped" inner bottom flap 38. Each bottom flap 38 includes an elongated spaced slot 40 and 42.

Connected by a horizontal score line 36 to the bottom edge of each of the rectangular side panels 14 and 18 is an outer bottom flap 44. A vertically extending tab 46 and 48 is cut from opposite edges of each panel 44. Each of the tabs 46 and 48 is pivotable about a double score line 50.

A pair of rectangular openings 52 and 54 are formed along the bottom horizontal score line 36 in each of the panels 14 and 18 wholly within the confines of each panel.

In order to erect container 10 from blank 12, the side wall panels 14, 16, 18 and 20 are folded 90° relative to each other about the vertical score lines 22. The rectangular panel 24 can be stapled, glued or adhesively connected to the exterior or interior surface of panel 20.

The bottom of container 10 is then formed as shown in FIGS. 2 to 5 by folding the inner bottom flaps 38 90° relative to side wall panels 16 and 20. The tabs 60 and 62 on the upper end of each inverted "T—shaped" flap 38 are inserted into facing openings 52 and 54 in the side walls 18 and 14 respectively. Similarly, the tabs 60 and 62 on the other inner bottom flap 38 connected to the side wall 20 is inserted into the second pair of facing openings 54 and 52 in the side walls 14 and 18, respectively. The tabs 60 and 62 are then bent 90° upwardly to lock the inner bottom flaps 38 to the side walls 14 and 18 providing lateral and vertical dimensional stability to the erected container 10 when stacked and filled.

The outer bottom flaps 44 are then folded about the score lines 36 until they overly the inner flaps 38. Tabs 46 and 48 on each outer flap 44 are inserted through one of the adjacent openings 40 or 42 in the inner flaps 38 and bent 180° about its double score line 50. The tabs 46 and 48 are then inserted through an adjacent opening 52 or 54 in the sidewall 18 or 14 and bent upwardly 90° as shown in FIG. 6. The tabs 46 and 48 on each outer bottom flap 44 lock the bottom flaps 38 and 44 and add to the lateral and vertical stability of the container 10.

The pairs of locking tabs 46 and 48, when bent 180° are in a position to be held down by a commodity packed into the interior of the container 10, thereby assuring locking of the bottom panels to the side walls and to each other under load.

The cover for container 10 can be formed as shown in FIGS. 2 and 6 by bending each of the inner top flaps 30 about the horizontal score line 26 until they extend towards each other. The tabs 56, 58 on the upper corners of the "T—shaped" inner flaps 30 are inserted in opposed openings 34 and 32 in the side walls 14 and 18, respectively and bent 90° downwardly to lock the inner top flaps to the side walls. The outer top flaps can then be folded relative to the horizontal score lines 26 and stapled or otherwise secured to each other and the inner flaps.

The locking tabs 56, 58 on the top flaps 30 restrain the minor or inner top flaps 30 from depressing, facilitating the stapling of the outer top flaps to each other and the inner top flaps to close the container. In addition, the insertion of the inner top flap tabs within facing openings 32 and 34 in the side walls 13, 18 provide lateral stability for the container, particularly when the assembled container is stacked on its sides. Having the side edges of the inner flaps 30 and 38 abut the side walls 14, 18 both at the top and at the bottom edges due to the flaps being locked in place, provides the requisite stability in both the lateral and vertical dimension.

What is claimed as new is:

1. A self-locking container comprising:

a plurality of side walls hingedly connected to each other, an inner bottom panel hingedly connected to a bottom edge of an opposed pair of said side walls, each of said inner bottom panels extending towards the other and including a pair of spaced slots and being T—shaped in plan defining a laterally extending tab along each side edge thereof, an outer bottom panel hingedly connected to a bottom edge of each of another opposed pair of said side walls overlying a portion of each of said inner bottom panels, each of said outer bottom panels extending towards each other and including a pair of spaced elongated tabs, each of said elongated tabs being bendable 180° relative to its outer bottom panel and inserted through one of said slots in each of said portions of said inner bottom panels to lock said outer bottom panels to said inner bottom panels, and a pair of spaced slots in each of said other opposed pair of side walls, each slot receiving one of said bent elongated tabs on an outer bottom panel and one of said laterally extending tabs on an inner bottom panel therethrough to lock said bottom panels to each other and said side walls.

2. The container of claim 1 including an inner top flap hingedly connected to a top edge of each of said opposed pair of side walls, each of said inner top flaps extending towards the other and being T—shaped in plan defining a laterally extending tab along each side edge thereof, an outer top flap panel hingedly connected to a top edge of each of another pair of opposed side walls, and a second pair of spaced slots in each of said other opposed pair of side walls, each of said slots receiving one of said laterally extending tabs on said inner top panels therethrough to lock said top panels to said side walls.

3. The container of claim 2 wherein each of said elongated tabs on said outer bottom panels in hingedly connected thereto along a double score line.

4. An integral, planar, paperboard blank for forming the container of claim 1.

5. An integral, planar, paperboard blank for forming the container of claim 2.

6. A blank for forming a self-locking container comprising:

a plurality of rectangular panels hingedly connected together along vertical score lines, each of said panels having a top and bottom edge, a first bottom panel connected to the bottom edge of alternate ones of said first rectangular panels, an inverted T—shaped bottom panel connected to the bottom edge of alternate ones of said first rectangular panels between said first bottom panels, said first bottom panels including a vertically extending tab adjacent a side edge thereof, and a horizontally extending slot along the bottom edge of each of said rectangular panels connected to said first bottom panel.

7. The blank of claim 6 including a first top flap hingedly connected to the top edge of alternate ones of said first rectangular panels, a T—shaped top flap connected to the top edge of alternate ones of said first rectangular panels between said first top flaps, and a pair of horizontally extending slots spaced along the top edge of said first rectangular panels connected to said first top flaps.

* * * * *